US009818338B2

(12) United States Patent
Ruan et al.

(10) Patent No.: US 9,818,338 B2
(45) Date of Patent: Nov. 14, 2017

(54) PRE-CHARGE DRIVER FOR LIGHT EMITTING DEVICES (LEDS)

(71) Applicant: Texas Instruments Incorporated, Dallas, TX (US)

(72) Inventors: Jiancong Ruan, Shenzhen (CN); Minyi Xie, Shenzhen (CN); Runqin Tan, Shenzhen (CN)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 14/638,723

(22) Filed: Mar. 4, 2015

(65) Prior Publication Data

US 2016/0260375 A1 Sep. 8, 2016

(51) Int. Cl.
*G09G 3/32* (2016.01)
*G09G 3/3233* (2016.01)
(Continued)

(52) U.S. Cl.
CPC ..... *G09G 3/32* (2013.01); *G09G 3/3233* (2013.01); *G09G 3/3241* (2013.01); *G09G 3/3283* (2013.01); *G09G 2310/0248* (2013.01); *G09G 2310/0251* (2013.01); *G09G 2310/0264* (2013.01); *G09G 2310/0291* (2013.01); *G09G 2310/0297* (2013.01); *G09G 2320/0209* (2013.01); *G09G 2320/0214* (2013.01);
(Continued)

(58) Field of Classification Search
CPC .. G09G 3/3233; G09G 3/3241; G09G 3/3283; G09G 2310/0248; G09G 2310/0251; G09G 2310/0291; G09G 2330/028
See application file for complete search history.

(56) References Cited

U.S. PATENT DOCUMENTS 5,004,901 A * 4/1991 Yoshimoto ..... H03K 17/603 250/201.5
5,670,973 A * 9/1997 Bassetti, Jr. ..... G09G 3/2011 345/100
(Continued)

OTHER PUBLICATIONS

Coughlin, et al., Operational Amplifiers and Liniear Integrated Circuits, Prentice-Hall 2nd Ed. 1982, p. 24 Fig. 2-9.*
(Continued)

*Primary Examiner* — Michael J Eurice
(74) *Attorney, Agent, or Firm* — William B. Kempler; Charles A. Brill; Frank D. Cimino

(57) ABSTRACT

An LED driver includes a current driver receiving a reference voltage providing a charging current for driving channel output(s) of an LED panel. A pre-charge circuit includes a voltage selector having a first and second select input, a control input receiving a pre-charge voltage select signal based on a next ON/OFF state that is after a current sub-period, and a voltage selector output for switchably outputting a higher voltage level (V_H) when the next state is OFF and a lower level (V_L) when the next state ON. An enable circuit has an enable input receiving an enable signal active during a break time of the current sub-period for driving the channel output when enabled with a pre-charge current to V_H or a relatively higher voltage level when the next state is OFF, and to V_L or a relatively lower voltage level when the next state is ON.

23 Claims, 9 Drawing Sheets

(51) Int. Cl.
*G09G 3/3241* (2016.01)
*G09G 3/3283* (2016.01)

(52) U.S. Cl.
CPC ..... *G09G 2320/0257* (2013.01); *G09G 2330/028* (2013.01)

(56) References Cited

U.S. PATENT DOCUMENTS 5,723,950 A * 3/1998 Wei ..... G09G 3/3216 315/169.3
6,339,414 B1 * 1/2002 Todokoro ..... B82Y 10/00 345/75.1
6,501,449 B1 * 12/2002 Huang ..... G09G 3/3216 345/212
2003/0030602 A1 * 2/2003 Kasai ..... G09G 3/325 345/76
2004/0222950 A1 * 11/2004 Kimura ..... G09G 3/325 345/76
2005/0001806 A1 * 1/2005 Ohmura ..... G09G 3/3614 345/92
2005/0140596 A1 * 6/2005 Lee ..... G09G 3/3233 345/76
2005/0219162 A1 * 10/2005 Tsuge ..... H03M 1/06 345/76
2006/0022206 A1 * 2/2006 Hayakawa ..... G09G 3/3233 257/82
2006/0125744 A1 * 6/2006 Klein ..... G09G 3/3216 345/82
2006/0158392 A1 * 7/2006 Liao ..... G09G 3/3216 345/76
2006/0238473 A1 * 10/2006 Hashimoto ..... G09G 3/3688 345/89
2007/0018916 A1 * 1/2007 Kim ..... G09G 3/3216 345/76
2007/0057874 A1 * 3/2007 Le Roy ..... G09G 3/3258 345/76
2007/0080905 A1 * 4/2007 Takahara ..... G09G 3/3233 345/76
2007/0126667 A1 * 6/2007 Nakamura ..... G09G 3/3233 345/76
2008/0007664 A1 * 1/2008 Ong ..... G09G 3/3614 349/37
2008/0117233 A1 * 5/2008 Mather ..... G09G 3/003 345/690
2008/0304294 A1 * 12/2008 Hsiao ..... H02M 1/08 363/21.18
2010/0134402 A1 * 6/2010 Groot Hulze ..... G09G 3/342 345/102
2010/0207967 A1 * 8/2010 Baek ..... G09G 3/3685 345/690
2012/0081352 A1 * 4/2012 Yamagishi ..... G09G 3/3614 345/212
2013/0278166 A1 * 10/2013 Katoh ..... H03K 17/00 315/224
2013/0321598 A1 * 12/2013 Inoue ..... G09G 3/20 348/54
2014/0128941 A1 * 5/2014 Williams ..... A61N 5/06 607/88
2015/0091784 A1 * 4/2015 Kwon ..... H03M 1/72 345/77

OTHER PUBLICATIONS

Coughlin, Robert F., et al., Operation Amplifiers and Linear Integrated Circuits, Prentice-Hall Inc., 2nd Ed. publ. 1982, p. 23-24.*

* cited by examiner

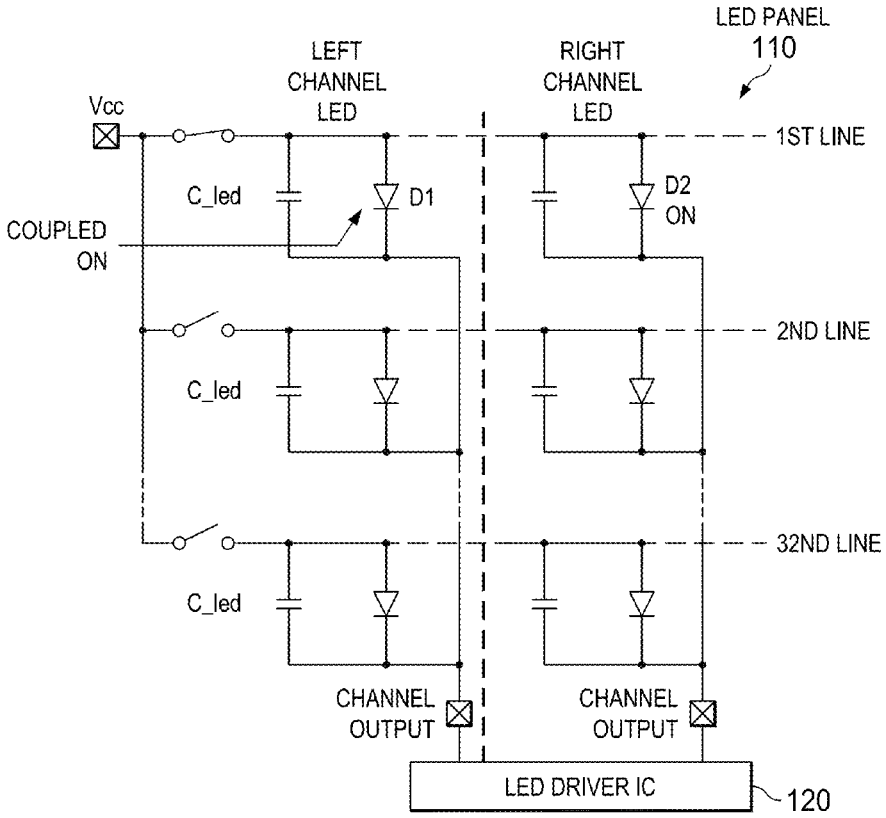
FIG. 1A
(PRIOR ART)
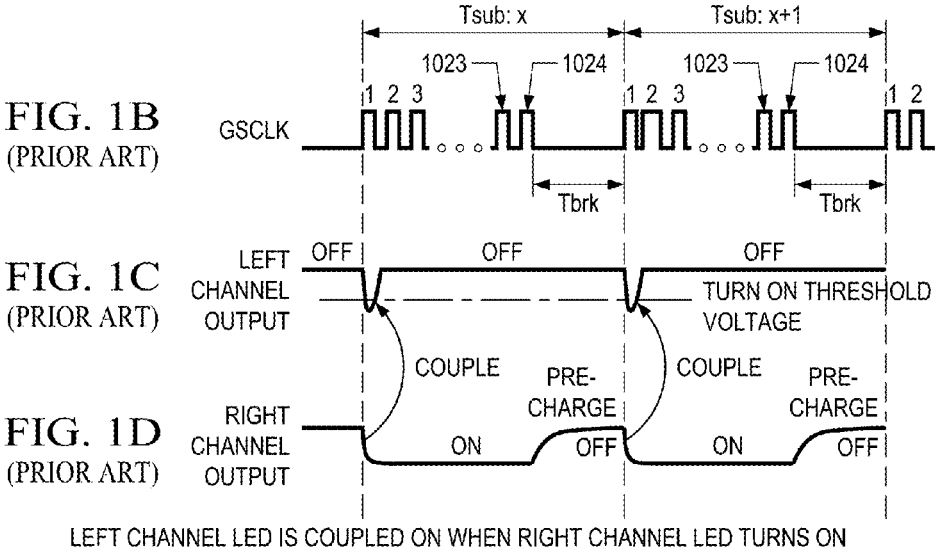
FIG. 1B
(PRIOR ART)
FIG. 1C
(PRIOR ART)
FIG. 1D
(PRIOR ART)

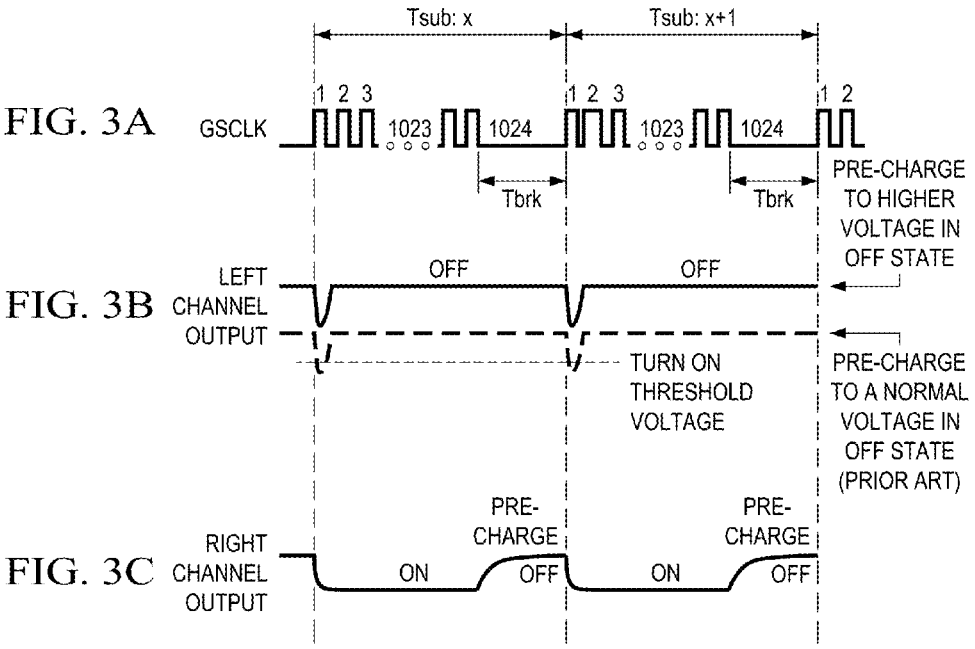
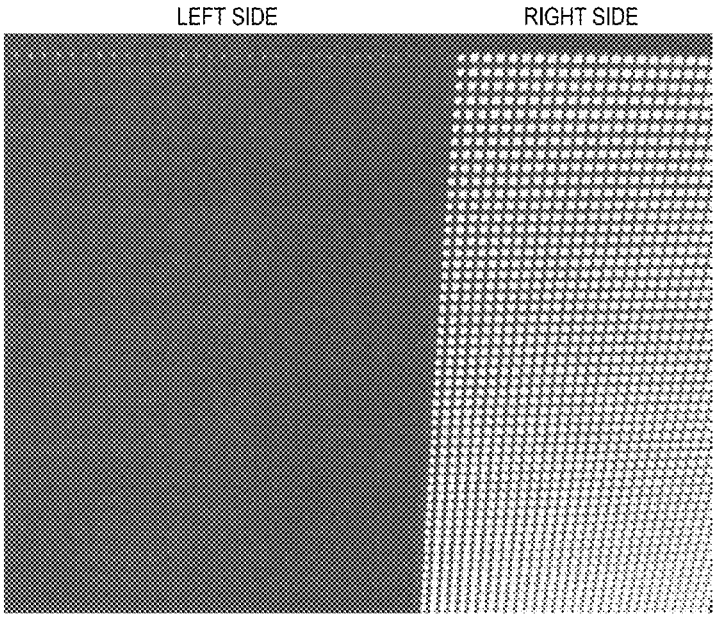
FIG. 4A
(PRIOR ART)

PRE-CHARGE DRIVER FOR LIGHT EMITTING DEVICES (LEDS)

FIELD

Disclosed embodiments relate to drivers for driving light emitting devices (LEDs), and more specifically to LED drivers having pre-charge circuits.

BACKGROUND

A light-emitting diode (LED) is a two-lead semiconductor light source comprising a pn-junction diode, which emits light when forward biased, where electrons from the semiconductor's conduction band recombine with holes from the valence band releasing sufficient energy to emits produce photons of a monochromatic (single color) of light. This effect is generally called electroluminescence, and the color of the light (corresponding to the energy of the photon) is determined by the band gap energy of the particular semiconductor material. A known way to control the brightness of LEDs is to use a control process technique known as "Pulse Width Modulation" (PWM) in which the LED is repeatedly turned "ON" and "OFF" at varying frequencies by a suitable PWM controller control signal depending upon the required light intensity.

LED panels (or arrays) are capable of generating relatively high amounts of light (high luminance), which allows video displays having LED panels to be used in a variety of ambient conditions. However, LEDs are known to be subject to a ghost lighting effect where ghost images result when though a current path through intended OFF LEDs adjacent to ON LEDs, which causes very faint illumination or "ghosting" of the intended OFF LEDs. These ghost-image currents typically result from the discharging of stray capacitances associated with the large, common-LED anode-node tracks and the slightly forward-biased LEDs themselves. To reduce ghost lighting problems a pre-charge circuit can be added to an LED driver for pre-charging an output node of the respective columns to a fixed target voltage when triggered by an ON/OFF control signal received from a controller, such as to a fixed pre-charge voltage of about Vcc-1.4V.

SUMMARY

This Summary briefly indicates the nature and substance of this Disclosure. It is submitted with the understanding that it will not be used to interpret or limit the scope or meaning of the claims.

Disclosed embodiments recognize although known light emitting diode (LED) drivers having pre-charge circuits which provide fixed driver pre-charge output voltage levels for coupling to channel outputs of LED channels are generally effective for removing ghost lighting effects, they cannot solve a cross-channel coupling problem discovered by the Inventors of this Application that can be present. This cross-channel coupling problem can cause image distortion in the LED panel display, which is more likely to be present in high gray-scales, particularly for high density LED panels.

The cross-channel coupling problem described in detail below with respect to FIGS. 1A-E and FIG. 4A below can be a significant issue for LED panels, wherein LEDs in the panel intended to be in the OFF-state can be coupled ON at the beginning of a new sub-period when an LED in an adjacent column is turned ON resulting in a current flowing through a cross-channel coupling path between the power supply (e.g., VCC) and the channel output of the adjacent channel. This cross-channel coupling path includes parasitic capacitance associated with LEDs in adjacent channels.

Disclosed embodiments include LED drivers including pre-charge circuits comprising a voltage selector such as multiplexer (MUX) which pre-charges the LEDs in a channel(s) to different voltages during the break time in a sub-period based on their conduction status (ON or OFF) scheduled for the next sub-period. When the channel is scheduled to turn ON in next sub-period, the channel output is pre-charged during the break time of the current sub-period to a lower voltage level (V_L), while when the channel is scheduled to turn OFF in next sub-period, the channel output is pre-charged during the break time of the current sub-period to a higher voltage level (V_H).

BRIEF DESCRIPTION OF THE DRAWINGS

Reference will now be made to the accompanying drawings, which are not necessarily drawn to scale, wherein:

FIG. 1A is a system diagram of an LED panel showing a left LED channel and a right LED channel each with 32 pixels (lines) with an LED driver IC shown driving the columns of the LED panel provided for describing the cross-channel coupling problem identified by the Inventors herein.

FIGS. 1B, C and D are timing diagrams showing an example grayscale clock (GSCLK) over 2 sub-periods, the left channel output of an LED panel, and the right channel output of the LED panel, respectively.

FIG. 1E illustrates an example cross-channel coupling path for an LED panel shown being through parasitic capacitors which can turn ON the LED in the left channel LED shown as D1 at the beginning of the sub-period when LED D2 in the right channel LED is turned ON.

FIGS. 3A, 3B and 3C show timing diagrams for an example GSCLK, the left channel output including an output waveform when using a known LED driver having a pre-charge circuit pre-charging to a conventional fixed voltage level and an output waveform when using disclosed LED driver including a pre-charge-circuit for pre-charging the channel output to a higher voltage in the OFF-state, and the right channel output shown being ON, respectively.

FIG. 4A is a scanned image of an LED panel showing the cross-channel coupling phenomenon when using a known LED driver having a pre-charge circuit providing a fixed pre-charge voltage level (VCC−1.4V), where the OFF-state LEDs in the left side of the LED panel are shown turned ON.

DETAILED DESCRIPTION

Figure 1E:
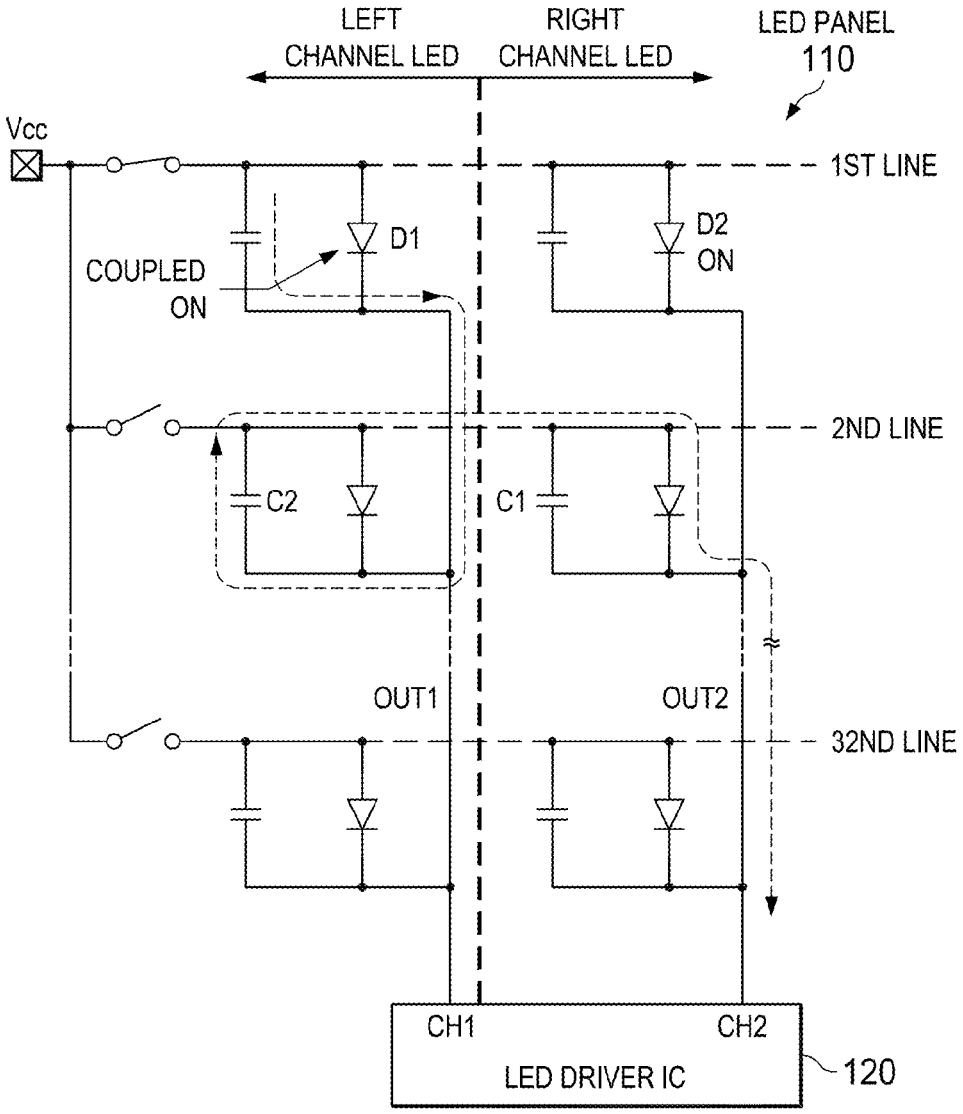

Example embodiments are described with reference to the drawings, wherein like reference numerals are used to designate similar or equivalent elements. Illustrated ordering of acts or events should not be considered as limiting, as some acts or events may occur in different order and/or concurrently with other acts or events. Furthermore, some illustrated acts or events may not be required to implement a methodology in accordance with this disclosure.

Also, the terms "coupled to" or "couples with" (and the like) as used herein without further qualification are intended to describe either an indirect or direct electrical connection. Thus, if a first device "couples" to a second device, that connection can be through a direct electrical connection where there are only parasitics in the pathway, or through an indirect electrical connection via intervening items including other devices and connections. For indirect coupling, the intervening item generally does not modify the information of a signal but may adjust its current level, voltage level, and/or power level.

FIG. 1A is a system diagram of an LED panel 110 shown having a left LED channel and a right LED channel each with 32 pixels (lines) with an LED driver IC 120 shown driving the channel output nodes of columns of the LED panel that is provided herein for describing the cross-channel coupling problem identified by the Inventors herein. The LEDs in the left LED channel include D1 identified, and D2 identified in the right LED channel, with each LED shown having a parasitic capacitance (C_led) thereacross (in parallel). In this example, all LEDs in the left channel including D1 are assumed to be intended to be kept in an OFF state at all times, although D1 is shown to be cross-coupled ON, and all the LEDs in the right channel including D2 are assumed to be turned ON during the sub-period of each line.

FIGS. 1B, C and D are timing diagrams showing an example clock shown as a GSCLK for 2 sub-periods, the left channel output, and the right channel output, respectively. In each sub-period shown having a time duration Tsub, after the 1,024 PWM steps in the GSCLK depicted there is a dead period (no PWM steps) referred to as the break time (Tbrk). In some applications the GSCLK may be replaced by a simple channel ON/OFF control signal.

During Tbrk the power supply exchanges from one line of LEDs to the next line of LEDs and the channel output is pre-charged by a known pre-charged circuit to a fixed pre-charge target voltage (e.g., VCC−1.4V) for removing the ghost-lighting issue. When the right channel output is first turning ON in each sub-period as shown in FIG. 1D, because of the cross-channel coupling problem, the left channel output in FIG. 1C is seen to be coupled ON (its voltage being below the turn ON threshold voltage shown), despite it being intended to be OFF.

Disclosed embodiments recognize the parasitic capacitance (Cled) across the LEDs is the root cause of the cross-channel coupling problem which is made worse by close column spacing in high density LED panels. FIG. 1E illustrates an example cross-channel coupling path (dashed line) for an LED panel 110. As shown in FIG. 1E, the cross-channel coupling path is through parasitic capacitors (shown as including C1 and C2) which can turn ON the LED shown as D1 in the left channel of the LED panel despite it being intended to be OFF at the beginning of the sub-period that LED D2 in the right channel is ON.

Figure 2A:
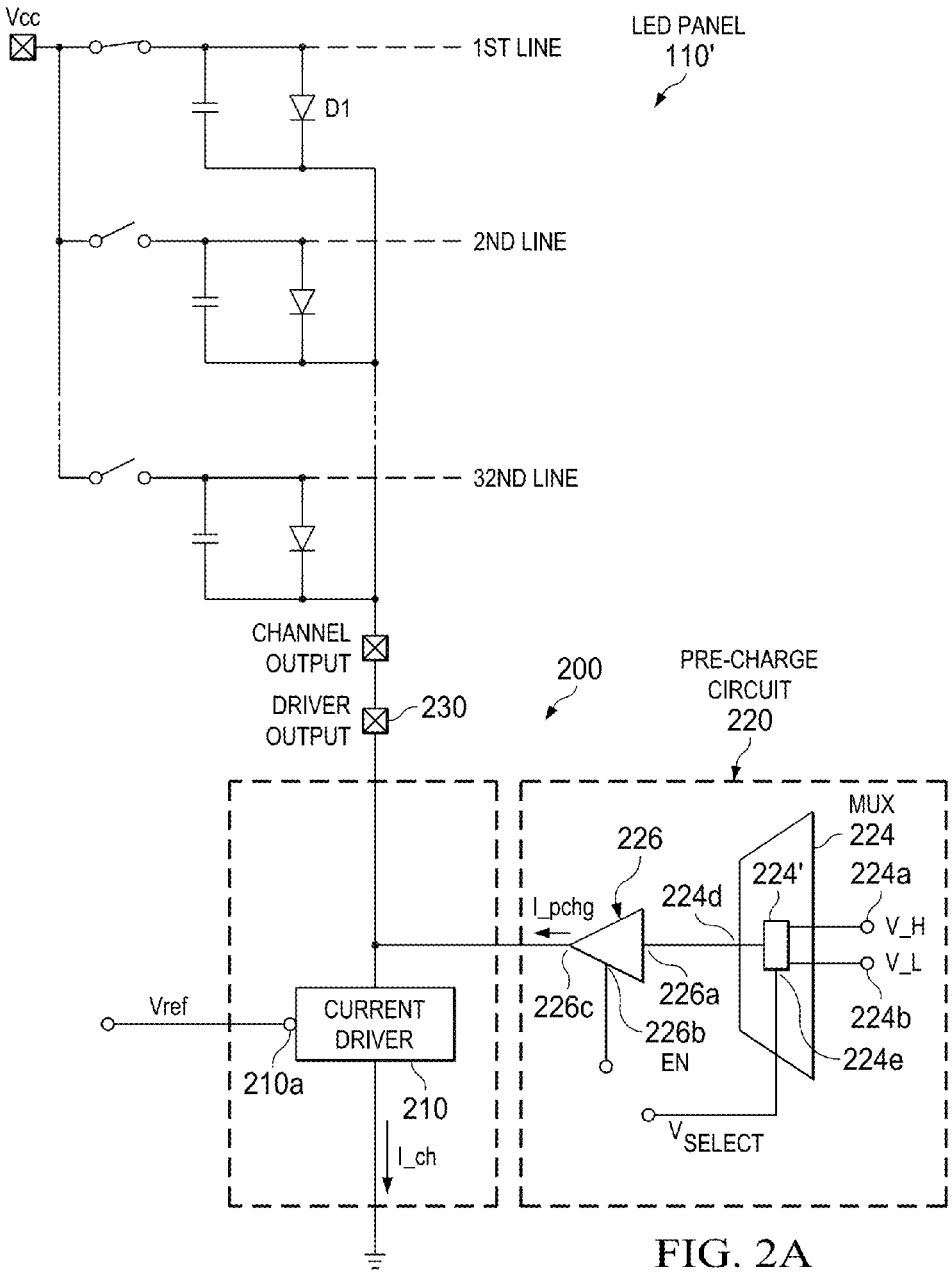
FIG. 2A is a depiction of an example LED driver including a pre-charge circuit for providing different pre-charge voltage levels for a channel of an LED panel based on the channel's next state (ON or OFF), according to an example embodiment.

FIG. 2A is a depiction of an example LED driver 200 including a pre-charge circuit 220 for providing different pre-charge voltage levels for the channels on an LED panel based on the channel's next state (ON or OFF), according to an example embodiment. The LEDs are shown as diodes each having a parasitic capacitor in parallel. The LED panel 110' is shown having only a single channel for simplicity. In practice, the LED panel generally includes at least 16 channels, such as three groups each including 16 channels, and the LED driver includes a separate driver output for each of the channels of the LED panel.

LED driver 200 includes a current driver 210 having an input 210*a* for receiving a reference voltage (shown as Vref, e.g., from a system controller) comprising a plurality of transistors (see FIG. 2B for an example transistor circuit) configured for providing a charging current (I_ch) at a driver output node 230 for driving the channel output of the channel shown of the LED panel 110', where the channel has 32 LED pixels (or lines, or rows). Vref can also be generated by an internal voltage reference, such as for example by a bandgap reference circuit so that the value of I_ch can depend on an external accurate resistor.

The pre-charge circuit 220 includes a MUX 224 functioning as a pre-charge voltage level selector which includes a first data input 224*a* for receiving a higher voltage level (V_H), and a second data input 224*b* for receiving a lower voltage level (V_L). MUX 224 also includes logic circuitry 224' including a control input 224*e* for receiving a pre-charge voltage select signal (Vselect) based on a state (ON or OFF) for a next sub-period (next state) of the channel that follows after a current sub-period for the channel for forwarding V_H to the MUX output 224*d* when the next state is an OFF-state and for forwarding V_L to the MUX output 224*d* when the next state is an ON-state. The logic circuitry 224' can comprise well known multiplexer logic circuitry, such as a network of AND gates.

An enable circuit shown as an amplifier 226 (e.g., operational amplifier) includes a first input 226*a* coupled to the MUX output 224*d*, and an enable (EN) input 226*b* for receiving an EN signal that is active during a break time of the current sub-period. Amplifier 226 has an output 226*c* coupled to the driver output node 230 for driving the channel output of the channel when enabled with a pre-charge current shown as I_pchg to a higher voltage level (e.g., V_H) when the next state for the channel is an OFF-state and to a lower voltage level (e.g., V_L) when the next state for the channel is an ON-state.

The pre-charge circuit 220 thus solves the above-described cross-coupling problem by using different pre-charge levels according the next sub-period state (ON or OFF) for the channel. The difference in V_H and V_L pre-charge levels may range, for example, from about at 0.1 V to 1 V. Since if the channel is scheduled to turn ON in next sub-period, the channel is pre-charged to lower voltage level during the break time, while if the channel is scheduled to be OFF in the next sub-period, the channel is pre-charged to higher voltage level during the break time, where the higher pre-charge voltage level helps avoid cross-coupling forcing the "OFF-state" LED to turn ON, while the lower pre-charge voltage level helps the intended next "ON-state" LED to turn ON (see experimentally obtained evidence shown in FIGS. 4A and 4B described below).

Figure 2B:
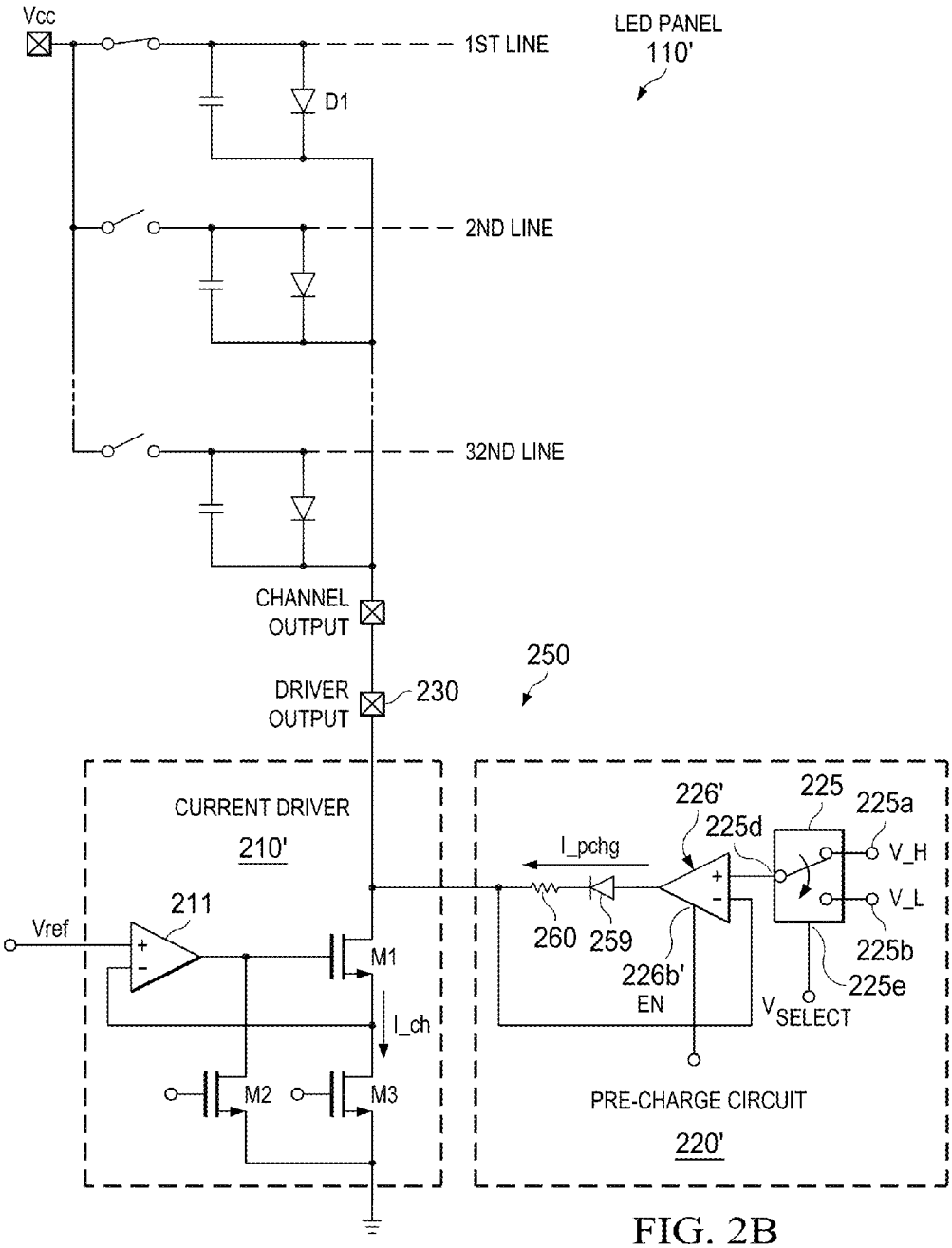
FIG. 2B is a depiction of another example LED driver including a pre-charge circuit for providing different pre-charge voltage levels based on the next channel state (ON or OFF), according to another example embodiment.

FIG. 2B is a depiction of another example LED driver 250 including a pre-charge circuit 220' for providing different pre-charge voltage levels based on the next channel state (ON or OFF), according to another example embodiment. Pre-charge circuit 220' includes a pre-charge voltage selector 225 that like MUX 224 in FIG. 2A is controlled by a Vselect input signal that is applied to its controlled input 225*e*. Pre-charge voltage selector 225 also includes a first data input 225*a* for receiving a higher voltage level (V_H) and a second data input 225*b* for receiving a lower voltage level (V_L). The pre-charge voltage selector's output is shown as 225*d*. The enable circuit shown as amplifier 226 in FIG. 2A is now shown as an operational amplifier 226' that is configured in a voltage follower configuration which has its non-inverting input coupled to output 225*d*. Operational amplifier 226' has an EN input 226*b'* for receiving an EN signal that is active during a break time of the current sub-period. The pre-charge current I_pchg is shown flowing through diode 259 and resistor 260 to the driver output 230. As with amplifier 226 described above, amplifier 226' drives the driver output 230 and thus the channel output of the channel when enabled with the pre-charge current I_pchg to a higher voltage level (e.g., V_H) when the next state for the channel is an OFF-state and to a lower voltage level (e.g., V_L) when the next state for the channel is an ON-state.

Regarding the function of the diode 259, when the voltage at the driver output node 230 is higher than the driver power supply (VCC) voltage, diode 259 can prevent the I_pchg following backward to the driver's power supply. Regarding function of the resistor 260, resistor 260 can limit the I_pchg current and enhance the ESD resistance capability of the driver output node 230.

The current driver 210' is shown including amplifier 211 shown as an operational amplifier in a non-inverting configuration receiving Vref at its non-inverting input having its output coupled to a drain of NMOS M2 and a gate of NMOS M1, where NMOS M1 has its drain connected to driver output 230 and its source to the drain of NMOS M3 which functions as a current source. The Vref signal shown coupled to the non-inverting input of amplifier 211 is a current source M3 drain clamping voltage reference signal. The source of NMOS M2 is connected to the source of NMOS M3, with both of these nodes connected to ground. The gate of NMOS M2 receives a current drive ON/OFF control signal and the gate of NMOS M3 receives a current source gate bias signal, both generally provided by a system controller (not shown).

Figure 2C:
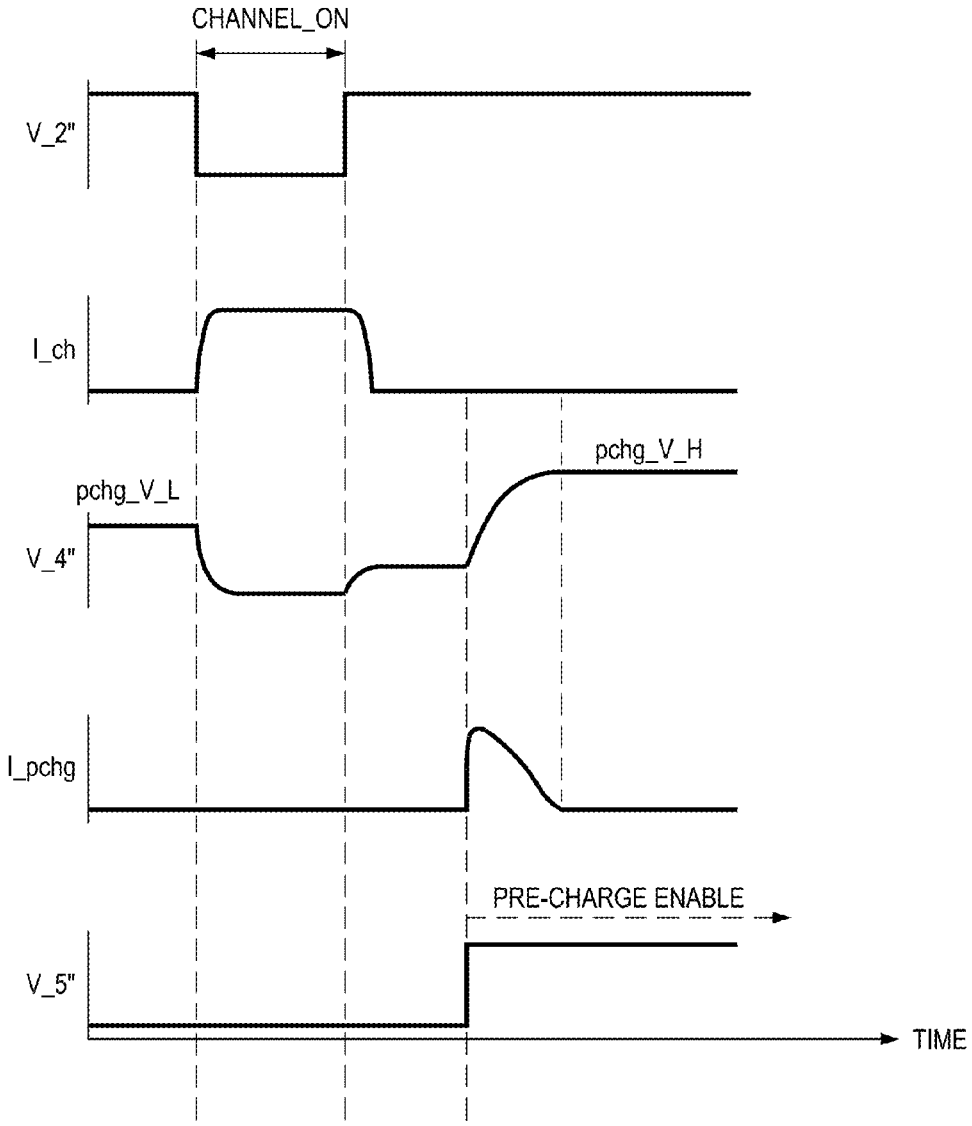
FIG. 2C is an example current driver ON/OFF and pre-charge circuit operational diagram for the LED driver depicted in FIG. 2B.

FIG. 2C shows an example current driver ON/OFF and pre-charge circuit operational diagram for the LED driver depicted in FIG. 2B. The waveform V_2" is the voltage input to the gate of M2, I_ch is the current waveform for the channel current shown as I_ch in FIG. 2B, the waveform V_4" is at the current driver channel output pin voltage waveform (node 230), the waveform I_pchg is the pre-charge current waveform shown as I_pchg in FIG. 2B, and V_5 is the pre-charge enable voltage signal waveform shown as EN in FIG. 2B.

Figure 2D:
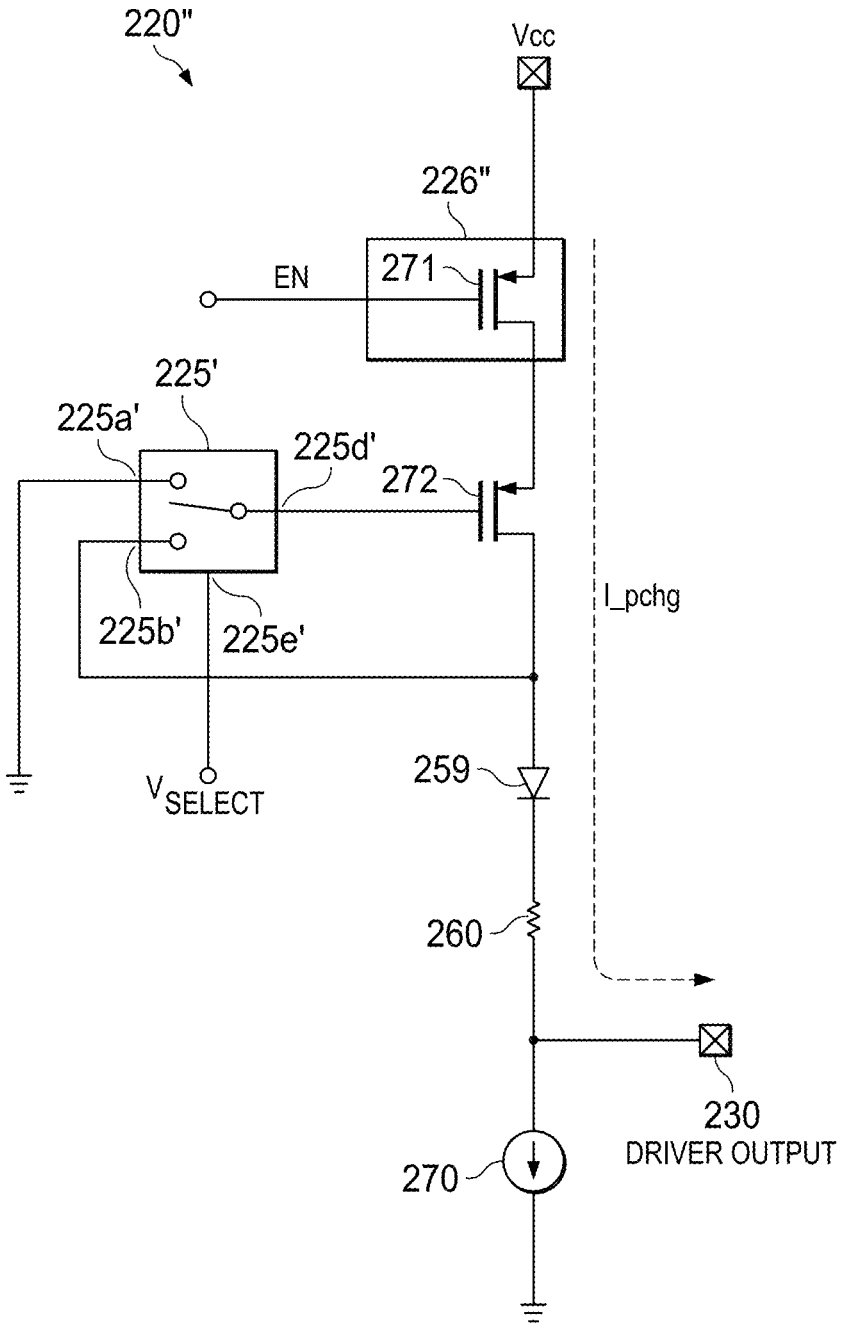
FIG. 2D is a depiction of another pre-charge circuit for providing different and adjustable pre-charge voltage levels based on the next channel state (ON or OFF), according to another example embodiment.

FIG. 2D is a depiction of another example pre-charge circuit 220" for providing different and adjustable pre-charge voltage levels based on the next channel state (ON or OFF), according to another example embodiment. Pre-charge circuit 220" includes an enable circuit 226" shown comprising a first PMOS transistor 271 that receives an EN input and a pre-charge voltage selector circuit 225' that receives a Vselect signal at its control input 225*e'*. Pre-charge voltage selector circuit 225' has first select input 225*a'*, second select input 225*b'* and voltage selector output 225*d'*. A second PMOS transistor 272 is coupled in series with the enable circuit 226" and has its gate electrode coupled to the voltage selector output 225*d'*, wherein a drain of the second PMOS transistor 272 is coupled to the second select input 225*b'*, with the first select input 225*a'* connected to ground. Diode 259 and resistor 260 are shown as before in the path of I_pchg. A current source 270 is shown coupled to the driver output 230.

Regarding operation of pre-charge circuit 220", the EN input as before is a pre-charge circuit enable signal that enables the pre-charge circuit 220" to provide I_pchg when the EN input is low ("0") which turns on the first PMOS transistor 271. The Vselect signal is coupled to the control input 225*e'*. The pre-charge voltage selector circuit 225' is controlled by a logic block (not shown). When the pre-charge voltage selector circuit 225' selects the first select input 225*a'* the driver output node 230 is pre-charged to V_H, and when the pre-charge voltage selector circuit 225' selects the second select input 225*b'* the driver output node 230 is pre-charged to V_L.

The current source 270 generally provides a relatively small clamp current (relative to I_pchg), where the current source 270 can comprise a programmable current source so that the clamp current provided by the current source 270 can be used to adjust the levels for both V_H and V_L. The magnitude of the clamp current provided by the programmable current source can be user programmable. In one specific, for example, a user pin selection for a packaged LED driver including a disclosed pre-charge circuit such as pre-charge circuit 220" changes a resistor ratio that results in changing a clamp current magnitude for the current source 270.

As the magnitude of clamp current increases, the voltage level at the driver output node 230 is reduced due to an increased IR (ohmic) drop across resistor 260, and as the magnitude of the clamp current decreases, and the voltage level at the driver output node 230 is increased due to a reduced IR drop across resistor 260. As noted above, pre-charge circuit 220" can adjust the voltage levels for both V_H and V_L. Pre-charge circuit 220" can thus provide not only adjustable V_L levels for channels in an LED display, including for an LED display having R/G/B channels, but also can provide adjustable V_H levels for LED displays including LED displays having R/G/B channels.

Figure 2E:
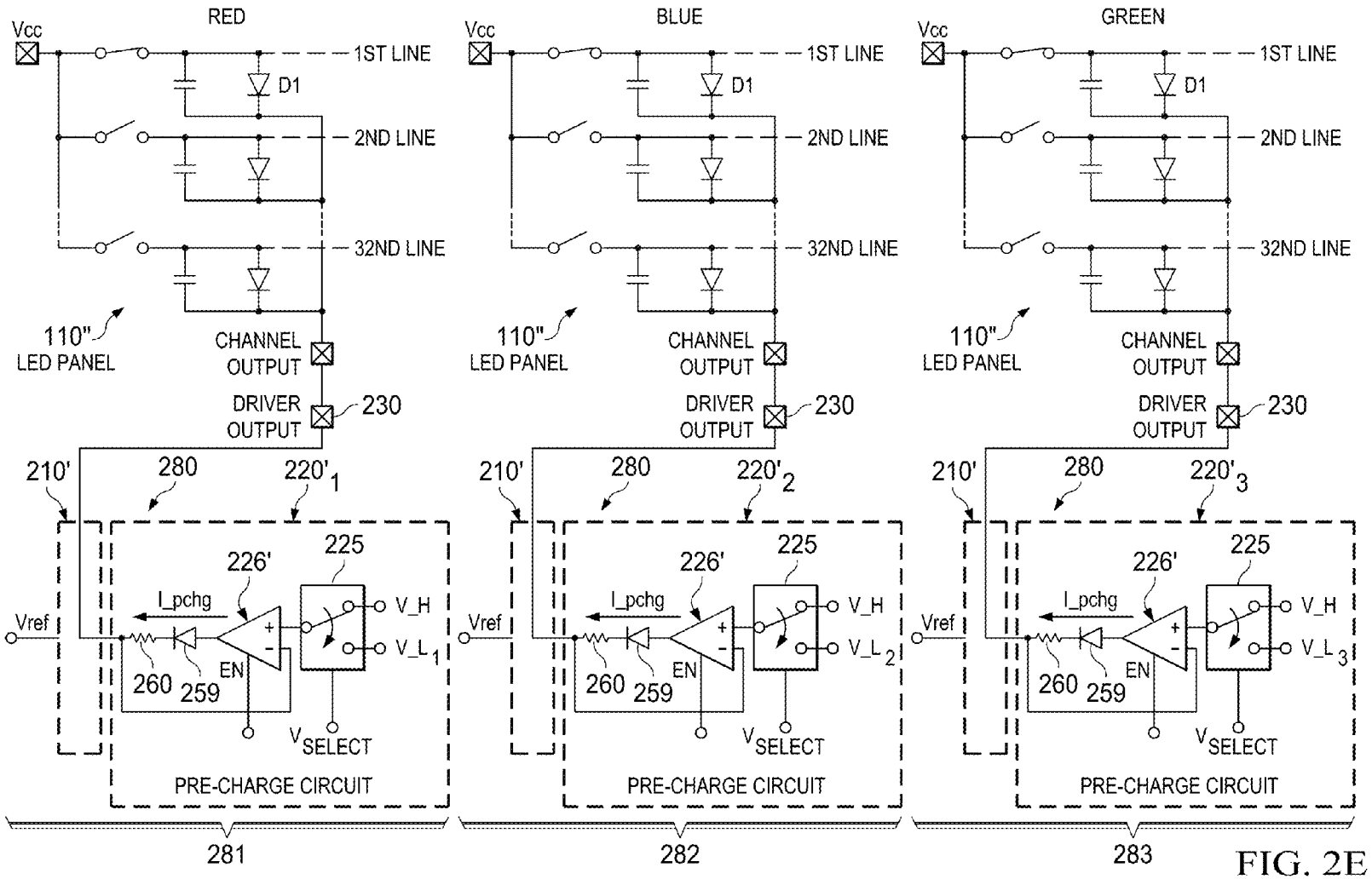
FIG. 2E is a depiction of another example LED driver driving an LED panel including a red, blue and green channel, where a first driver channel is for driving a red LED channel, a second driver channel is for driving the blue LED channel, and a third driver channel is for driving as green LED channel, each with pre-charge voltage levels based on the next channel state, where the pre-charge circuits in each driver channel receive different V_L levels from their controller and as a result, provide different V_L levels for the red LED channel, green LED channel and blue LED channel, according to another example embodiment.

FIG. 2E is a depiction of another example LED driver 280 driving an LED panel 110" including a red, blue and green channel, where a first driver channel 281 is for driving a red LED channel, a second driver channel 282 is for driving the blue LED channel, and a third driver channel 283 is for driving the green LED channel, each with pre-charge voltage levels based on the next channel state (ON or OFF), according to another example embodiment. The pre-charge circuits in each driver channel 220'$_1$, 220'$_2$, 220'$_3$ receive different V_L levels from their system controller (not shown) shown as $V_L_1$, $V_L_2$, and $V_L_3$, respectively, and as a result, provide different V_L levels for the red LED channel, green LED channel and blue LED channel.

FIGS. 3A, 3B and 3C show timing diagrams for an example GSCLK, the left channel output using a disclosed pre-charge circuit pre-charging to a higher voltage level in the OFF-state and a known pre-charge circuit pre-charging to a conventional voltage level, and the right channel output (turning ON in each sub-period), respectively. The GSCLK waveform in FIG. 3A is equivalent to the GSCLK waveform shown in FIG. 1B, and the right channel output waveform in FIG. 3C is equivalent to right channel output waveform shown in FIG. 1D, while FIG. 3B depicts the left channel output waveform shown in FIG. 1C (marked as prior art) along with the left channel output waveform resulting from disclosed pre-charging to a higher voltage in the OFF-state.

As noted above, in some applications the GSCLK may be replaced by a simple channel ON/OFF control signal, which can also be handled by disclosed LED drivers. As shown in FIG. 3B, the disclosed higher pre-charge voltage level in the OFF-state helps keep the LED OFF (e.g., always stays at a voltage level that is above the turn ON threshold voltage level shown) which for a known pre-charge circuit the LED in the left channel output is coupled ON (pre-charge voltage level is below the turn ON threshold voltage level shown) during the start of both sub-periods as shown.

Disclosed pre-charge circuits providing different pre-charge voltage levels (e.g., V_H and V_L, based on the next state being ON or OFF) thus help solve the cross-channel coupling problem because the cross-coupling current is recognized to be proportional to output voltage drop of the LED in ON-state. A lower pre-charge voltage level for the channel to turn ON results in the voltage drop being smaller for the channel turn ON. Moreover, the coupling current is inversely proportional to the pre-charge voltage level in OFF-state channel. If the OFF-state channel is pre-charged to a higher voltage level as disclosed herein, it becomes more difficult to be coupled ON.

EXAMPLES

Disclosed embodiments are further illustrated by the following specific Examples, which should not be construed as limiting the scope or content of this Disclosure in any way.

Figure 4B:
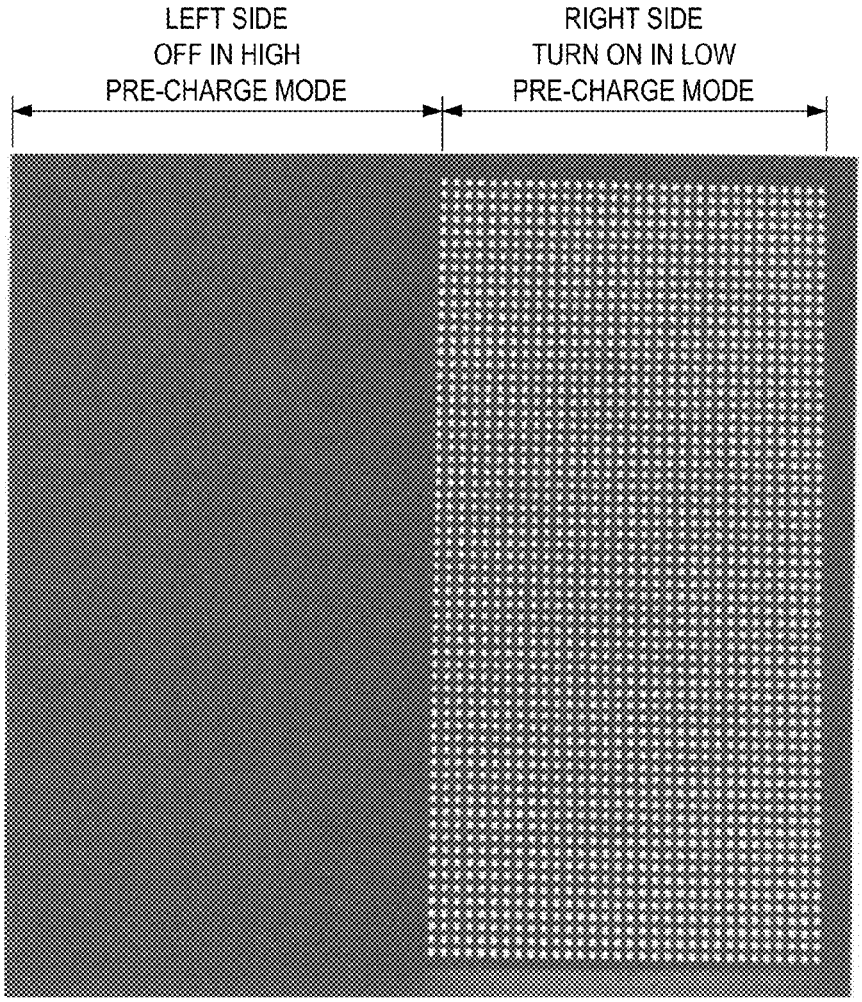
FIG. 4B is a scanned image of the multi-scan (32 scans) LED panel shown in FIG. 4A evidencing elimination of the cross-channel coupling problem when using a disclosed LED driver having a disclosed pre-charge circuit providing pre-charging to different pre-charge voltage levels for the channel based on the channel's next state (ON or OFF).

Evidence of LED drivers having a disclosed pre-charge circuit providing improved LED panel performance with respect to the channel cross-coupling problem has been proven by results of a laboritory experiments as shown in the scanned images of an LED panel provided in FIGS. 4A and 4B. The LED panel used for the experiment was a multi-scan (32 scans) LED panel comprising silicon pn junction LEDs with 64 pixels, 192 channels or columns, with 96 left side columns and 96 right side columns. The clock signal used was similar to the GSCLK shown in FIG. 3A, except there were 256 clocks in one Tsub not 1,024 as shown in FIG. 3A. The VCC level was =5V, and Tbrk was =20 μS. The LED panel used a "high-gray scale" panel with Gray Scales bits=16 bits, so that the Gray Scales=65536. As used herein, a high-Gray Scale panel refers to Gray Scales bits ≥12 bits, so that the Gray Scales ≥4096.

FIG. 4A is a scanned image of an LED panel showing the cross-channel coupling phenomenon when using a known LED driver having a pre-charge circuit providing a fixed pre-charge voltage level (VCC-1.4V), where all LEDs on the left side of the panel are cross-coupled ON by the LEDS on the right side of the panel. The top two rows of the LEDs on the left side can be seen to be more intense as compared to the other rows, with the difference between top two rows and the rows beneath these rows being the pre-charge time, where the top two rows of LEDs were not pre-charged to target voltage, and the additional rows below ware pre-charged to the target voltage of VCC−1.4V. The cross-channel coupling problem is a more of a problem for high gray-scales, which can cause significant image distortion in the LED panel display.

In contrast, FIG. 4B is a scanned image of the same multi-scan LED panel shown in FIG. 4A evidencing the elimination of the cross-channel coupling problem when using an example LED driver having a disclosed pre-charge circuit provided by the LED driver 250 shown in FIG. 2B including current driver 210' and pre-charge circuit 220' providing disclosed pre-charging. The V_L pre-charge level was =Vcc−1.4V, and V_H pre-charge level was =Vcc−0.8V. The right LED channels work in a low pre-charge mode, pre-charged to V_L, where the right channels turn ON in each sub-period. The left channels work in a high pre-charge mode, pre-charged to V_H in the OFF-state all the time without any cross-coupling turning them ON. Disclosed LED drivers with disclosed pre-charge circuits pre-charging OFF-state channels to a higher voltage level are thus advantageously more difficult to be cross-coupled ON, thus evidencing their effectiveness in solving the cross-channel coupling problem.

Those skilled in the art to which this disclosure relates will appreciate that many other embodiments and variations of embodiments are possible within the scope of the claimed invention, and further additions, deletions, substitutions and modifications may be made to the described embodiments without departing from the scope of this disclosure.

The invention claimed is:

1. A light emitting diode (LED) driver for driving a plurality of channels of the LED array, comprising:

a current driver having an input for receiving a reference voltage and a plurality of transistors configured providing a charging current at a driver output node for driving a channel output of a first channel of the LED panel having a plurality of LED pixels for selecting LEDs to be activated, and a pre-charge circuit including:

a voltage selector having a first select input, a second select input, a control input for receiving a pre-charge voltage select signal that is based solely on whether a next period after the current period is in a ON state, or in a OFF state and a voltage selector output for switchably outputting a higher voltage level (V_H) when said next period is an OFF-state and outputting a lower voltage level (V_L) when said next period is an ON-state, and an enable circuit between a high side power supply node and said driver output node having an enable input for receiving an enable signal that is active during a break time of said current period for driving said channel output of said first channel when enabled with a pre-charge current to said V_H or a relatively higher voltage level when said next state is an OFF-state and to said V_L or a relatively lower voltage level when said next state is an ON-state wherein ghosting of the intended OFF state LEDs is reduced.

2. The LED driver of claim 1, further comprising a MOS transistor coupled in series with said enable circuit having a gate coupled to said voltage selector output, wherein a source or a drain of said MOS transistor is coupled to said first select input or to said second select input.

3. The LED driver of claim 1, further comprising at least one diode and a resistor coupled in series between said enable circuit and said driver output node, said diode for blocking said pre-charge current if backward and said resistor for limiting said pre-charge current.

4. The LED driver of claim 1, wherein said voltage selector comprises a multiplexer (MUX) including a first data input for receiving said V_H and a second data input for receiving said V_L, and an amplifier having a first input coupled to an output of said MUX having an amplifier output coupled to said driver output node.

5. The LED driver of claim 4, wherein said amplifier is an operational amplifier configured as a voltage follower.

6. The LED driver of claim 1, further comprising a current source coupled to said driver output node for providing a clamp current, wherein a magnitude of said clamp current adjusts a level for both said V_H and said V_L.

7. The LED driver of claim 6, wherein said current source comprises a programmable current source for adjusting said magnitude of said clamp current which adjusts said level for V_H and said level for V_L.

8. A method of operating an LED panel including at least a first channel having a plurality of LED pixels, comprising:

pre-charging a channel output of said first channel during a break time of a current sub-period to a lower voltage level (V_L) solely when said first channel is to be turned ON in a next sub-period, and pre-charging said channel output of said first channel during said break time for said current sub-period to a higher voltage level (V_H) solely when said first channel is to be OFF in said next sub-period;

operating and enable circuit between a relatively high power supply voltage level and at relatively low power supply voltage level wherein ghosting of intended OFF LEDs is reduced.

9. The method of claim 8, wherein said LED panel includes red channel, a green channel and a blue channel, and wherein said V_L is different for said red channel, said green channel and said blue channel.

10. The method of claim 8, wherein said LED panel further comprises a second channel adjacent to said first channel, wherein said second channel is OFF at least a portion of time that said first channel is ON.

11. The method of claim 8, further comprising a system controller sending a pre-charge enable signal at a start of a break time during a sub-period that is used to begin said pre-chargings.

12. The method of claim 8, wherein a magnitude of said V_H minus said V_L is at least 0.1 V.

13. The method of claim 8, further comprising controlling a level for both said V_H and said V_L using a current source providing a clamp current.

14. The method of claim 13, wherein said current source comprises a programmable current source, further comprising adjusting a magnitude of said clamp current which adjusts said level for V_H and said level for V_L.

15. The method of claim 14, wherein said programmable current source comprises a user programmable current source, and said adjusting comprises a user adjustment.

16. A light emitting diode (LED) system, comprising:

an LED panel including at a plurality of channels each having a plurality of LED pixels and a channel output, and an LED driver including:

a current driver having an input for receiving a reference voltage and a plurality of transistors configured providing a charging current at a driver output node for driving said channel output, and a pre-charge circuit including:

a voltage selector having a first select input, a second select input, a control input for receiving a pre-charge voltage select signal that is based on whether in a next period after the current period the plurality of LEDs will be in an ON state or an OFF state and a voltage selector output for switchably outputting a higher voltage level (V_H) solely when said next state is an OFF-state and outputting a lower voltage level (V_L) solely when said next state is an ON-state, and an enable circuit between a high side power supply node and said driver output node having an enable input for receiving an enable signal that is active during a break time of said current sub-period for driving said channel output of said first channel when enabled with a pre-charge current to said V_H or a relatively higher voltage level when said next state is an OFF-state and to said V_L or a relatively lower voltage level when said next state is an ON-state wherein ghosting of intended off LEDs is reduced.

17. The system of claim 16, wherein said voltage selector comprises a multiplexer (MUX) including a first data input for receiving said V_H and a second data input for receiving said V_L, and an amplifier having a first input coupled to an output of said MUX having an amplifier output coupled to said driver output node.

18. The system of claim 16, further comprising a MOS transistor coupled in series with said enable circuit having a gate coupled to said voltage selector output, wherein a source or a drain of said MOS transistor is coupled to said first select input or to said second select input.

19. The system of claim 16, further comprising at least one diode and a resistor coupled in series between said enable circuit and said driver output node, said diode for blocking said pre-charge current if backward and said resistor for limiting said pre-charge current.

20. The system of claim 16, wherein said LED panel includes red channel, a green channel and a blue channel, and wherein said V_L is different for said red channel, said green channel and said blue channel.

21. The system of claim 16, wherein said LED panel further comprises a second channel adjacent to said first channel, wherein said second channel is OFF at least a portion of time that said first channel is ON.

22. The system of claim 16, further comprising a current source coupled to said driver output node for providing a clamp current, wherein a magnitude of said clamp current adjusts a level for both said V_H and said V_L.

23. The system of claim 22, wherein said current source comprises a programmable current source for adjusting said magnitude of said clamp current which adjusts said level for V_H and said level for V_L.

* * * * *